US008821647B2

(12) United States Patent
Naber et al.

(10) Patent No.: US 8,821,647 B2
(45) Date of Patent: Sep. 2, 2014

(54) BULK DISPENSE SEMI-MANUAL CLEANING SYSTEM FOR AN APPLIANCE

(75) Inventors: Christopher Nils Naber, Louisville, KY (US); Bryan T. Snook, Louisville, KY (US); Aaron Lee Welch, Louisville, KY (US); Todd Anthony Reger, Crestwood, KY (US)

(73) Assignee: General Electric Company, Schenectady, NY (US)

( * ) Notice: Subject to any disclaimer, the term of this patent is extended or adjusted under 35 U.S.C. 154(b) by 122 days.

(21) Appl. No.: 13/400,738

(22) Filed: Feb. 21, 2012

(65) Prior Publication Data

US 2013/0213441 A1 Aug. 22, 2013

(51) Int. Cl.
*A47L 15/44* (2006.01)
*D06F 39/06* (2006.01)

(52) U.S. Cl.
CPC ..... *D06F 39/06* (2013.01); *A47L 15/449* (2013.01)
USPC ..... 134/22.12; 134/25.2

(58) Field of Classification Search
CPC .... B08B 3/08; B08B 9/032; B08B 2209/032; D06F 39/02; D06F 39/022; A47L 15/0055; A47L 15/0057; A47L 15/4463; A47L 15/449
USPC ..... 134/22.11, 22.12, 22.18, 25.2
See application file for complete search history.

(56) References Cited

U.S. PATENT DOCUMENTS

| | | | | |
|---|---|---|---|---|
| 5,110,013 | A * | 5/1992 | Clark et al. | 222/382 |
| 6,160,245 | A * | 12/2000 | Broker et al. | 219/506 |
| 7,980,102 | B2 | 7/2011 | Kim et al. | |
| 2005/0229951 | A1 * | 10/2005 | Park | 134/22.1 |
| 2007/0130700 | A1 | 6/2007 | Cho et al. | |
| 2010/0000578 | A1 * | 1/2010 | Hendrickson et al. | 134/34 |
| 2010/0064446 | A1 | 3/2010 | Bae et al. | |

* cited by examiner

*Primary Examiner* — Michael Barr
*Assistant Examiner* — Caitlin N Dunlap
(74) *Attorney, Agent, or Firm* — Dority & Manning, P.A.

(57) ABSTRACT

Cleaning of a bulk dispense system of an appliance is provided. The appliance can include a user accessible compartment whereby the bulk dispense system is connected to a supply of a cleaning fluid. The appliance can be activated so as to flow the cleaning fluid through the bulk dispense system to help clean the system by e.g., removing particulates of detergent, fabric softener, and/or other undesirable matter that may be in the system.

17 Claims, 5 Drawing Sheets

BULK DISPENSE SEMI-MANUAL CLEANING SYSTEM FOR AN APPLIANCE

FIELD OF THE INVENTION

The subject matter of the present disclosure relates generally to a system for cleaning a bulk dispense system in an appliance.

BACKGROUND OF THE INVENTION

Modern appliances are increasingly equipped with bulk dispense systems for the convenience of the user. For example, washing machines can be provided with one or more containers of a fluid additive that is automatically dispensed at the appropriate time and amounts during the wash cycle of the appliance. The fluid additives may include laundry detergent, fabric softener, and/or other additives as desired. Such systems can provide convenience to the user and also ensure that the proper amounts are dispensed. An improper amount of laundry detergent, for example, can provide e.g., insufficient cleaning and/or a deleterious effect on clothing.

Typically, fluid additive is drawn from the bulk dispense container and through tubing or pipes that lead to a chamber or bin of the appliance where the fluid additive may be mixed with water or other fluids. A pumping device may be used to provide for movement of the fluid additive through the dispensing system. For example, the pumping device may be a peristaltic type pump.

Over the life of the appliance, there can be extended periods of inactivity depending upon e.g., the application and/or habits or schedule of the user. With a washing machine, the user may go on an extended vacation or may only attend to laundry once a week or less. Additionally, the appliance might be used and then taken out of service for a period of time until needed again.

During such periods of inactivity, fluid additives that are left in the dispensing system can dry out, harden, or otherwise create deposits that can clog the dispensing system. These deposits may substantially constrict the flow of additive through the system or even completely block or plug tubing, pipes, or pumping devices depending on the length of inactivity. Unfortunately, conventional appliances typically do not provide for a user of the appliance to readily access and clean the dispensing system of the appliance.

Accordingly, a system whereby a user can access and clean the dispensing system of an appliance would be useful. More particularly, a system whereby a user can circulate one or more cleaning fluids from the dispensing system to reduce or eliminate particles or deposits of a fluid additive would be beneficial. Such a system that can also provide notification(s) to the user regarding the cleaning process would also be useful.

BRIEF DESCRIPTION OF THE INVENTION

Aspects and advantages of the invention will be set forth in part in the following description, or may be obvious from the description, or may be learned through practice of the invention.

In one exemplary aspect, the present invention provides a method for cleaning a bulk dispense system of an appliance. The method includes steps of providing a user-accessible bulk dispense container for an additive fluid, the container selectively connected by a hose to a pumping device of the appliance; disconnecting the hose from the container; reconnecting the hose with a supply of a cleaning fluid; activating the pumping device of the appliance so as to draw cleaning fluid into the hose; flowing the cleaning fluid through the bulk dispense system; disconnecting the hose from the cleaning fluid; and, reconnecting the hose with the bulk dispense container.

In another exemplary aspect, the present invention provides a method for cleaning a bulk dispense system of an appliance. The bulk dispense system has a pumping device connected with at least one container for a fluid additive. The method includes the steps of providing a user-accessible compartment into which the container for a fluid additive is received; accessing the container for the fluid additive by opening the compartment; connecting the pumping device with a cleaning fluid; and, activating the pumping device to cause the cleaning fluid to flow through at least a portion of the bulk dispense system.

In one exemplary embodiment of the present invention, a washing machine appliance having a bulk dispense system is provided. The appliance includes a pumping device connected to a bulk dispense container. The washing machine includes at least one processing device configured for notifying a user of the appliance to clean the bulk dispense system; activating the pumping device to pull cleaning fluid into the bulk dispense system upon being prompted by the user; stopping the pumping device after a predetermined time interval during which a cleaning fluid was passed through at least a portion of the bulk dispense system; and, providing a notification regarding deactivation of the pumping device, reconnecting a bulk dispense container, or both.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
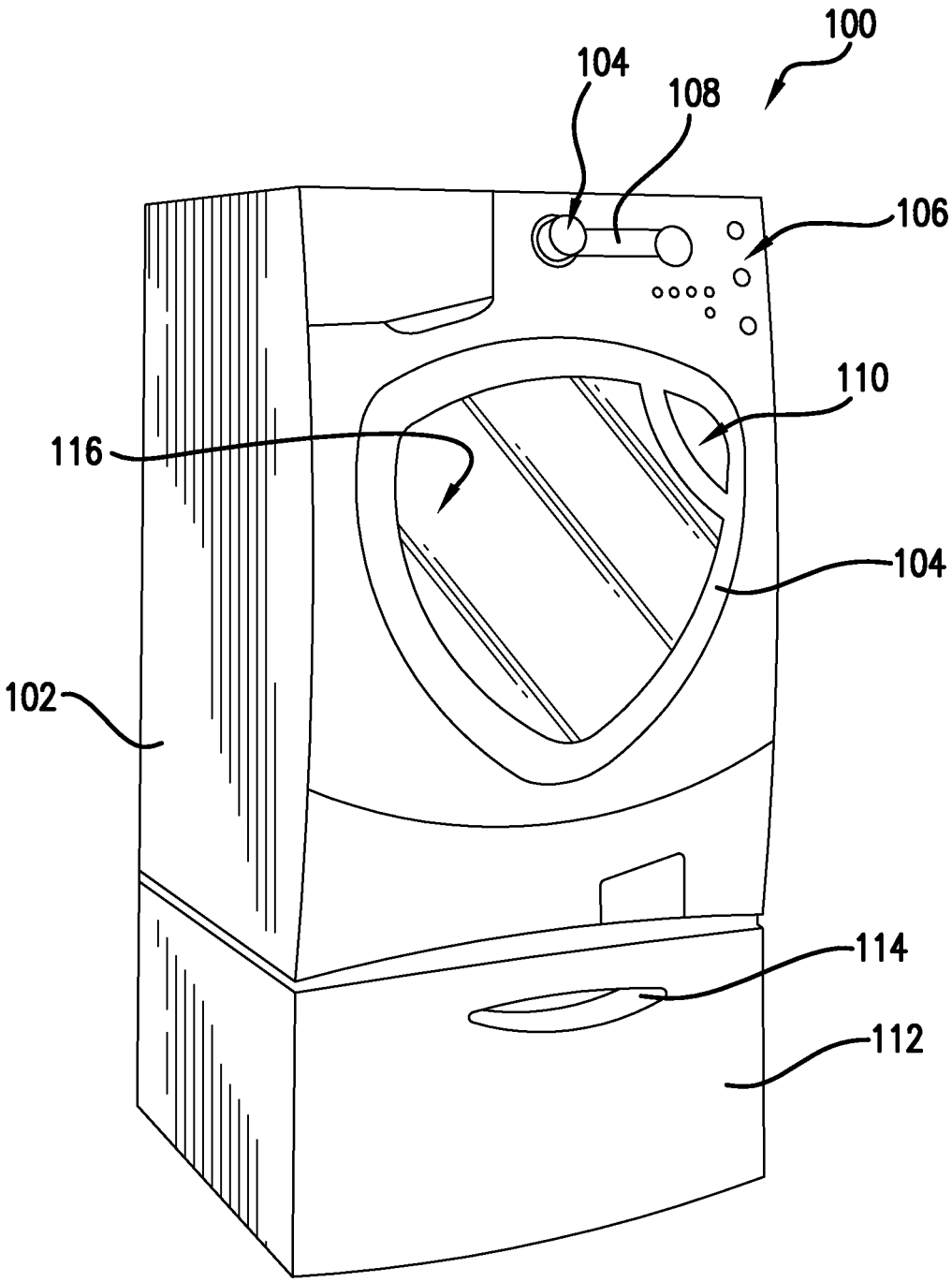
FIG. 1 provides a perspective view of an exemplary embodiment of a washing machine appliance of the present invention.

The present invention relates to the cleaning of a bulk dispense system of an appliance. The appliance is provided with a user accessible compartment whereby the bulk dispense system is connected to a supply of a cleaning fluid. The appliance can be activated so as to flow the cleaning fluid through the bulk dispense system to help clean the system by e.g., removing particulates of detergent, fabric softener, and/or other undesirable matter that may be in the system.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of an exemplary embodiment of a washing machine appliance 100 of the present invention. The present invention, however, is not limited to washing machine appliances and may be used with other appliances having a bulk dispense system. For example, the present invention could be used with a dishwashing appliance having a bulk dispense system for detergent and/or rinse additives. Similarly, although shown with a horizontal axis washing machine, the present invention may be used with vertical axis washing machines as well.

Washing machine 100 includes a cabinet 102 that encloses a wash basket for the receipt of laundry articles such as e.g., clothing and linens. Cabinet 102 also includes a wash tub for holding wash and rinse fluids and into which the wash basket is received. A door 104 with handle 110 provides for selective access to the wash basket and seals the fluids and laundry articles inside the wash basket during use. A window 116 made of glass or another transparent material allows a user to view the wash basket and/or laundry items during operation.

A selector knob 106 along with other user controls 106 are mounted on the front of cabinet 102 along with display 108. Controls 106 are in communication with a processing device or controller (not shown) that is also connected with display 108. Signals generated in the controller operate appliance 100 based on e.g., selections made by the user with controls 106. Information regarding selections made by the user and/or the status of operation of the appliance can be provided by display 108. Such processing device or control may be programmed or configured to provide a variety of operating cycles and other features for washing machine 100. As used herein, "processing device" or "controller" may refer to one or more microprocessors or semiconductor devices and is not restricted necessarily to a single element. The processing device may include, or be associated with, one or memory elements such as e.g., electrically erasable, programmable read only memory (EEPROM).

Figure 2:
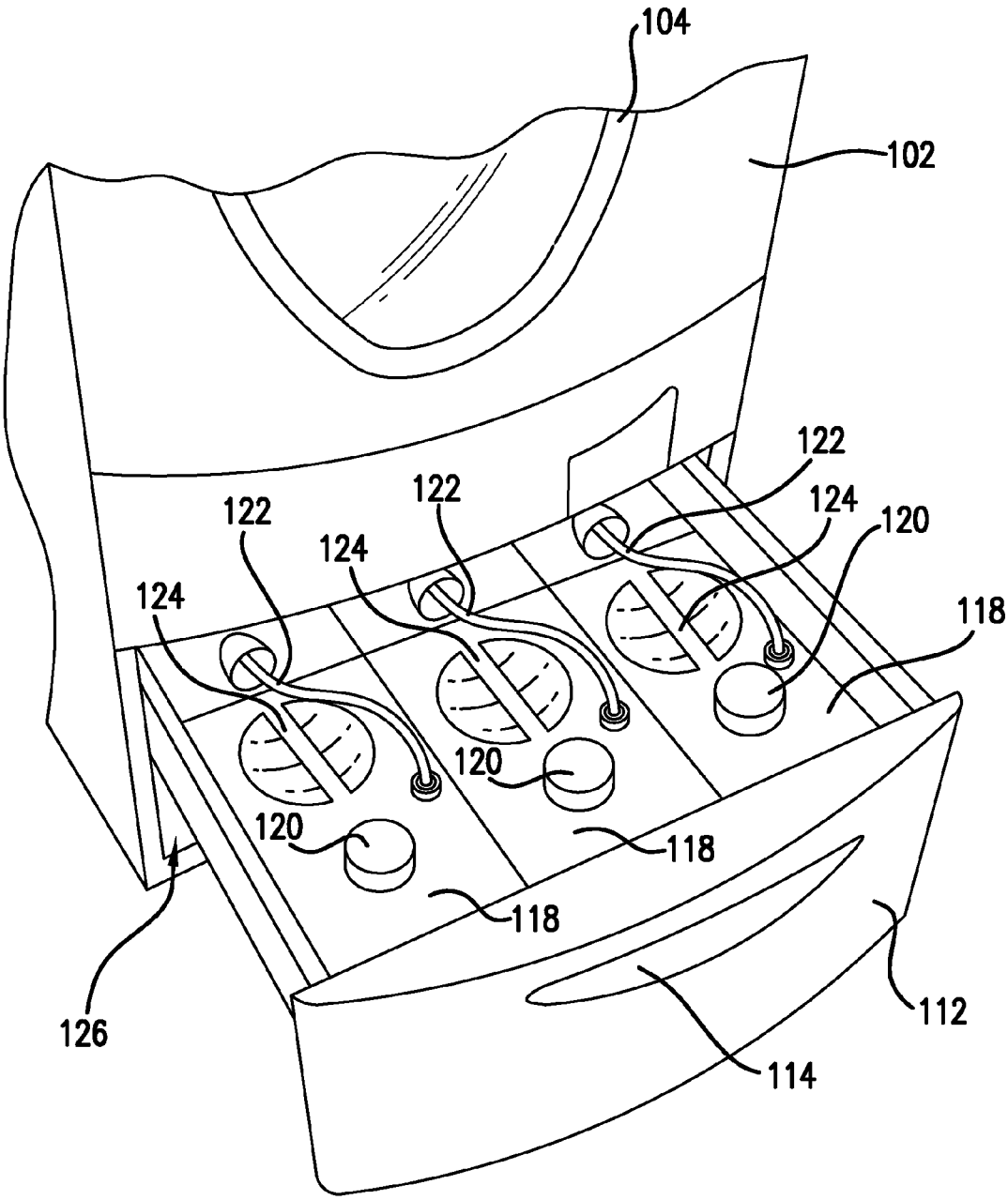
FIG. 2 provides a perspective view of the bottom portion of the exemplary embodiment of FIG. 1 with a compartment for bulk dispense containers shown in the open position.

Referring now to FIGS. 1 and 2, washing machine 100 includes a compartment or drawer 112 containing several bulk dispense containers 118. Drawer 112 may be opened or closed using handle 114. As shown in the figures for this exemplary embodiment, the bulk dispense containers 118 are accessible to the consumer without having to disassemble the appliance or use special tools to gain access to the bulk dispense containers. Each container 118 has a handle 124 for movement of the container and a cap whereby a fluid additive can be replenished or, alternatively, container 118 can be replaced. A variety of compartments may be used and the present invention is not limited to drawer 112 as shown in FIG. 1. For example, a pocket door, tray, or other feature may be used to provide ready access to one or more bulk dispense containers and may be located on the appliance differently from that shown in FIGS. 1 and 2.

Figure 3:
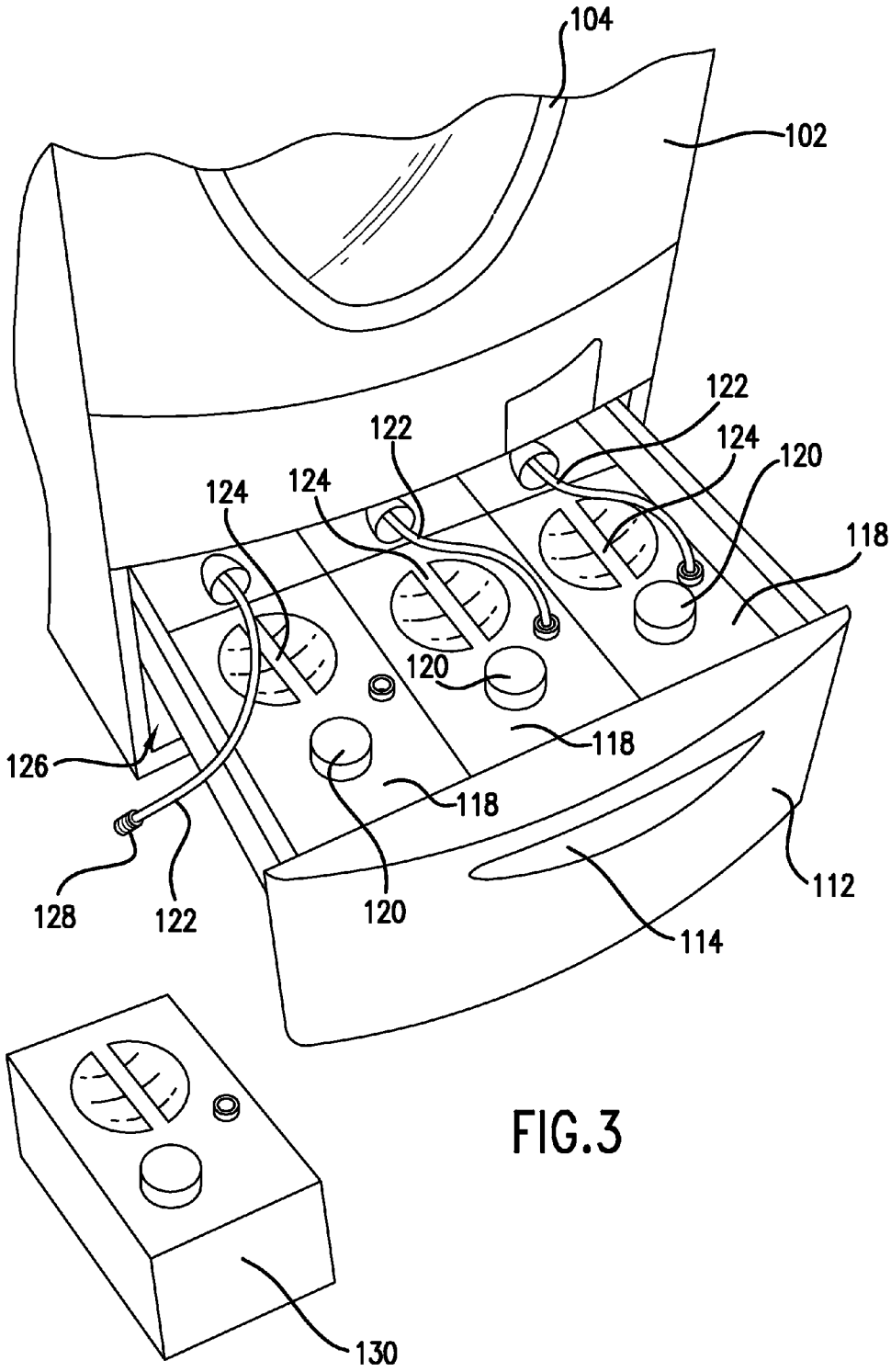
FIG. 3 provides the same perspective view as FIG. 2 except with a hose disconnected from one of the bulk dispense containers.

To clean the bulk dispense system of appliance 100, the user opens drawer 112 and disconnects bulk dispense container 118 from hose 122 as shown in FIG. 3. As shown, hose 122 includes a connector 128 that can be provided in the form of a quick disconnect type that can be readily disconnected and reconnected by the user. Hose 122 is connected with a pumping device (not shown) such as e.g., a peristaltic pump, that pulls fluid additive from a container into hose 122 when the pump is activated.

Appliance 100 can be provided with various features to notify or alert the user that the dispensing system should be cleaned. For example, the processing device could be programmed to provide a notification after a predetermined number of wash cycles have been completed, after the appliance has been idle for a period of time, and/or after a clog or poor flow of the fluid additive is detected. Other triggers can also be used for determining when to provide the user with a notification. Such notification can be e.g., a visual and/or audible alarm or other signal to a user of the appliance using display 108. The time interval for cleaning could also be defined by, or otherwise controlled by, the user.

Figure 4:
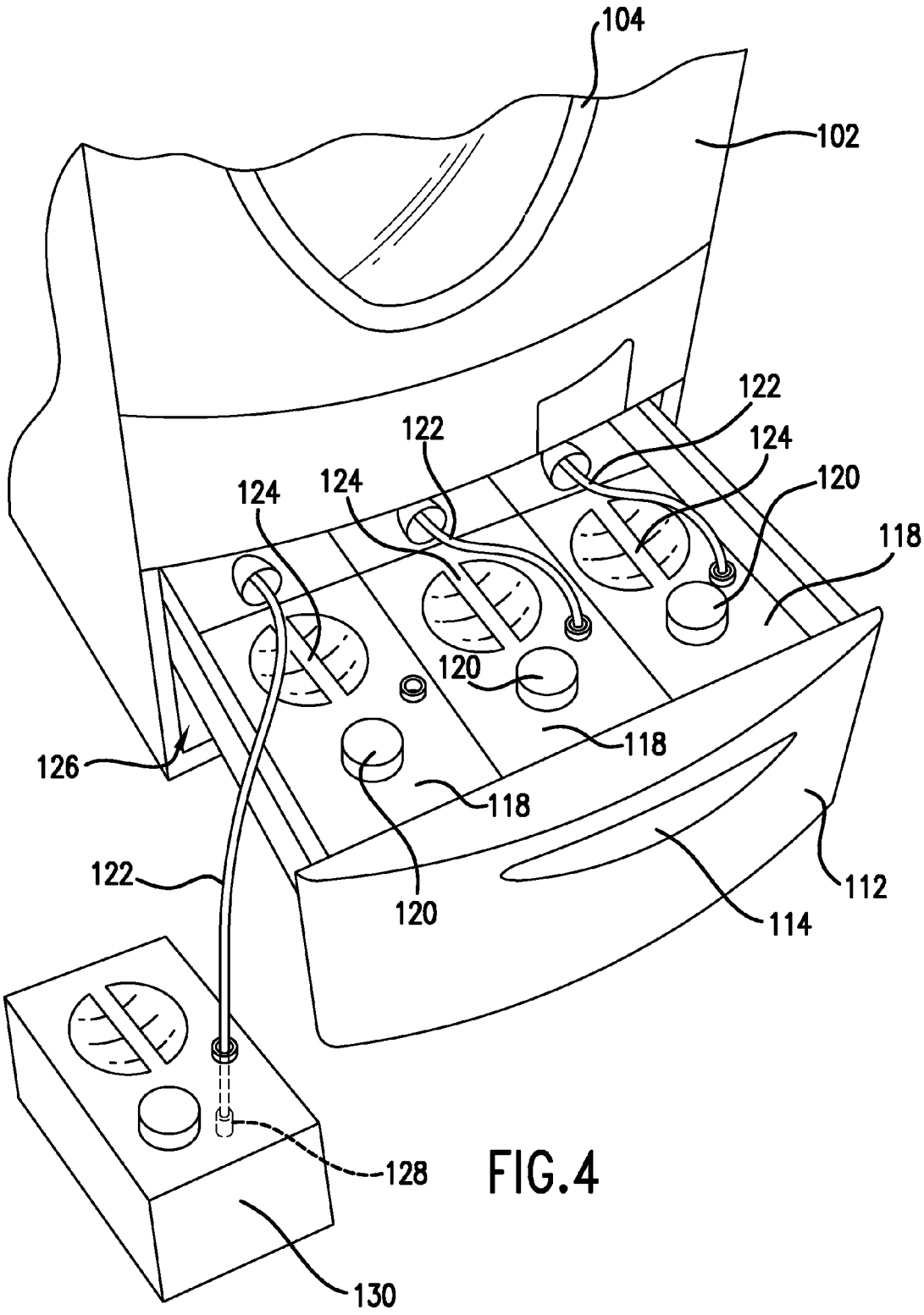
FIG. 4 provides the same perspective view as FIG. 2 except with a hose connected to a supply of a cleaning fluid.

Turning now to FIG. 4, in one exemplary aspect of the present invention, once hose 122 is disconnected, the user reconnects hose 122 with a supply of cleaning fluid in container 130 as shown in FIG. 4. By way of example, cleaning fluid in container 130 could be water or could be a special formulation used to remove deposits, clogs, and/or other undesirable materials from the bulk dispense system of appliance 100. Container 130 could be filled by the user of the appliance with a cleaning fluid or could be provided by a manufacturer already filled with a cleaning fluid. For this example, container 130 is similar to bulk dispense containers 118 and readily receives connector 128.

Once hose 122 is connected with cleaning fluid container 130, the user activates the pumping device of appliance 100 so as to draw cleaning fluid into hose 122 and flow the cleaning fluid through the bulk dispense system. For example, the user may be able to select a bulk dispense system cleaning mode using controls 106 and display 108. In this mode, once the controller is prompted by the user, the controller can activate the pumping device to begin the cleaning operation. The pumping device could be operated e.g., for a predetermined period of time that is sufficient to flow all or some predetermined portion of cleaning fluid from container 130 through the bulk dispense system. Alternatively, the controller might be configured to determine when container 130 has been emptied by e.g., determining changes in the load on the pumping device. Regardless, the cleaning fluid is passed through the bulk dispense system to remove particulates, deposits, and other build ups of the fluid additive such as detergent or fabric softener. The elements that constitute the bulk dispense system can vary from appliance to appliance and can include e.g., one or more pumps, hoses, connectors, and other elements through which the fluid additive passes before being delivered to e.g., a wash chamber or wash tub of the appliance such as the wash tub of washing machine 100.

After flowing the cleaning fluid through the bulk dispense system for cleaning, the pumping device is deactivated. The user could determine that the pumping device has stopped by listening for the sound of the device. Alternatively, the controller of washing machine 100 could provide another alert or notification to the user indicating that the bulk dispense cleaning cycle has been completed. For washing machine 100, the controller may also operate a drain pump or otherwise take steps to remove the used cleaning fluid from e.g., a wash chamber or wash bin of the appliance.

After the pumping device has been deactivated, hose 122 is then disconnected from cleaning fluid container 130 and reconnected to bulk dispense container 118. If needed, the process can be repeated for each of the bulk dispense containers 118 if more than one is present as with the exemplary appliance 100 as shown in FIGS. 2-5.

Figure 5:
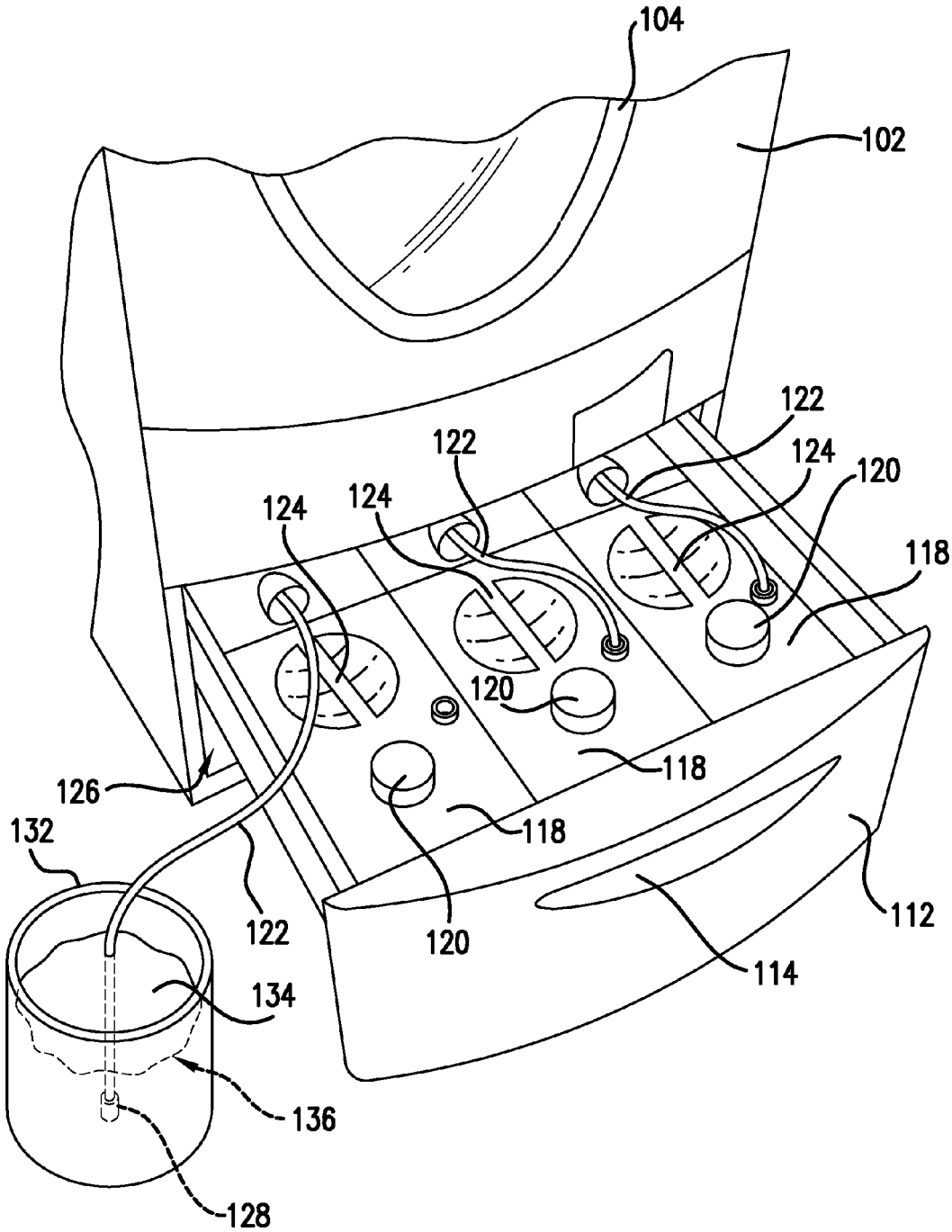
FIG. 5 provides the same perspective view as FIG. 2 except with a hose immersed in a supply of a cleaning fluid.

FIG. 5 illustrates another exemplary aspect of the invention in which hose 122 has been disconnected as previously described. However, for this embodiment, hose 122 is immersed below the fluid level 136 of a cleaning fluid 134 provided in a bucket or other container 132. In this exemplary aspect of the invention, a special container is not needed for connecting cleaning fluid 134 using hose 122. Instead, the pumping device is activated to pull cleaning fluid 134 from a bucket or other container 132 that may be e.g., provided by a user of the appliance. Again, cleaning fluid 134 may be water or may be a special formulation provided by the manufacturer of the appliance. Fluid 134 could also be e.g., a mixture prepared by the user from a concentrate provided by the manufacturer. Otherwise, the steps previously described with FIGS. 2-4 would also be applied with this exemplary embodiment as well.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for cleaning a bulk dispense system of an appliance, the method comprising the steps of:

providing a user-accessible bulk dispense container for an additive fluid, the container selectively connected by a hose to a pumping device of the appliance;

disconnecting the hose from the container;

connecting the hose to a supply of a cleaning fluid outside of the appliance;

activating the pumping device of the appliance so as to draw the cleaning fluid into the hose;

flowing the cleaning fluid through the bulk dispense system;

disconnecting the hose from the supply of the cleaning fluid; and, reconnecting the hose to the bulk dispense container.

2. A method for cleaning a bulk dispense system according to claim 1, wherein said flowing step further comprises operating the pumping device for a predetermined time interval.

3. A method for cleaning a bulk dispense system according to claim 1, wherein the cleaning fluid comprises water.

4. A method for cleaning a bulk dispense system according to claim 1, wherein the hose further comprises a connector positioned at one end of the hose.

5. A method for cleaning a bulk dispense system according to claim 1, further comprising the step of providing a notification to the user to perform a cleaning of the bulk dispense system of the appliance.

6. A method for cleaning a bulk dispense system according to claim 1, wherein the bulk dispense system is part of a washing machine appliance, the method further comprising the steps of flowing the cleaning fluid to a wash chamber of the appliance and draining the cleaning fluid from the wash chamber of the appliance.

7. A method for cleaning a bulk dispense system according to claim 1, wherein said step of providing a user-accessible bulk dispense container for an additive fluid comprises providing a compartment into which the bulk dispense container is received, the compartment having a door or drawer that is accessible by a user of the appliance without the use of a tool for gaining access to the bulk dispense container.

8. A method for cleaning a bulk dispense system according to claim 1, further comprising the step of providing a notification once said step of flowing is at or near completion.

9. A method for cleaning a bulk dispense system according to claim 1, wherein the cleaning fluid comprises a mixture of water and an additive for removing deposits of the additive fluid from the bulk dispense system.

10. A method for cleaning a bulk dispense system of an appliance, the bulk dispense system having a pumping device connected with at least one container for a fluid additive, the method comprising the steps of:

providing a user-accessible compartment into which the container for a fluid additive is received;

accessing the container for the fluid additive by opening the compartment;

connecting the pumping device to a container of a cleaning fluid outside the appliance; and, activating the pumping device to cause the cleaning fluid to flow through at least a portion of the bulk dispense system.

11. A method for cleaning a bulk dispense system of an appliance according to claim 10, further comprising the step of:

disconnecting the pumping device from the container for the fluid additive after said step of accessing.

12. A method for cleaning a bulk dispense system of an appliance according to claim 11, wherein said step of connecting comprises joining a suction line of the pumping device to the container of the cleaning fluid.

13. A method for cleaning a bulk dispense system of an appliance according to claim 11, wherein said step of connecting comprises immersing at least part of a suction line of the pumping device within the container of the cleaning fluid.

14. A method for cleaning a bulk dispense system of an appliance according to claim 10, further comprising the step of:

notifying a user of the appliance to clean the bulk dispense system.

15. A method for cleaning a bulk dispense system of an appliance according to claim 10, wherein the pumping device is operated for a predetermined time interval after said step of activating.

16. A method for cleaning a bulk dispense system of an appliance according to claim 10, wherein the pumping device is operated until all of the cleaning fluid has been fed through the bulk dispense system.

17. A method for cleaning a bulk dispense system of an appliance according to claim 16, further comprising the step of:

notifying a user of the appliance when all of the cleaning fluid has been fed through the bulk dispense system.

* * * * *